United States Patent [19]

Nixon et al.

[11] 4,261,142

[45] Apr. 14, 1981

[54] FORM RELIEVING APPARATUS

[76] Inventors: Raymond F. Nixon, 760 Orion Rd., Apt. 232, Lake Orion, Mich. 48035; Gait Barr, 25800 Meadowdale, Franklin, Mich. 48025

[21] Appl. No.: 961,300

[22] Filed: Nov. 16, 1978

[51] Int. Cl.[3] ..... B24B 3/22

[52] U.S. Cl. ..... 51/225; 51/219 PC

[58] Field of Search ..... 51/225, 219 PC, 234, 51/100 R

[56] References Cited

U.S. PATENT DOCUMENTS

| | | | |
|---|---|---|---|
| 2,325,364 | 7/1943 | Boening | 51/219 PC |
| 2,358,241 | 9/1944 | Moody | 51/225 |
| 2,471,539 | 5/1949 | Parker | 51/225 X |
| 2,482,802 | 9/1949 | Sanders | 51/100 R X |
| 2,752,740 | 7/1956 | Mouw | 51/225 X |
| 3,081,585 | 3/1963 | Boggis | 51/234 |
| 3,138,903 | 6/1964 | Mertens | 51/234 X |
| 3,608,248 | 9/1971 | Nixon | 51/225 |

*Primary Examiner*—Harold D. Whitehead
*Attorney, Agent, or Firm*—Gifford, VanOphem, Sheridan & Sprinkle

[57] ABSTRACT

A form relieving apparatus for providing axial and radial relief for a cutting tool such as a drilling or reaming bit, including a workpiece supporting carriage mounted for rectilinear movement in one of two perpendicular directions or in any direction therebetween and means for moving said supporting carriage a selected distance in a selected direction to move said cutting tool into and out of engagement with a grinding wheel.

4 Claims, 7 Drawing Figures

Fig-1
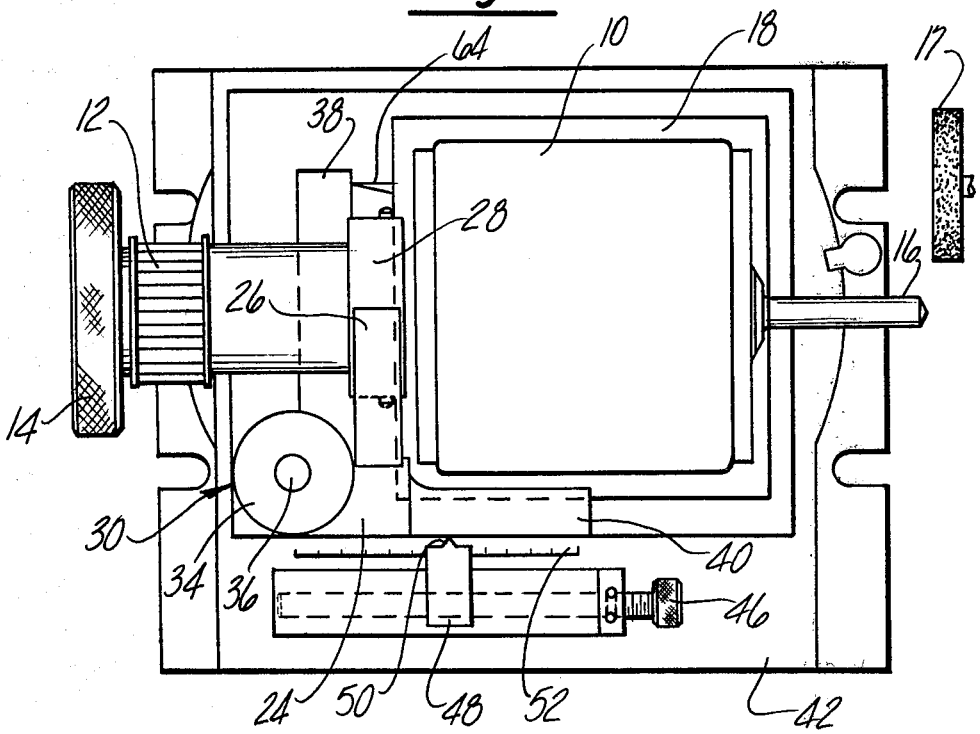
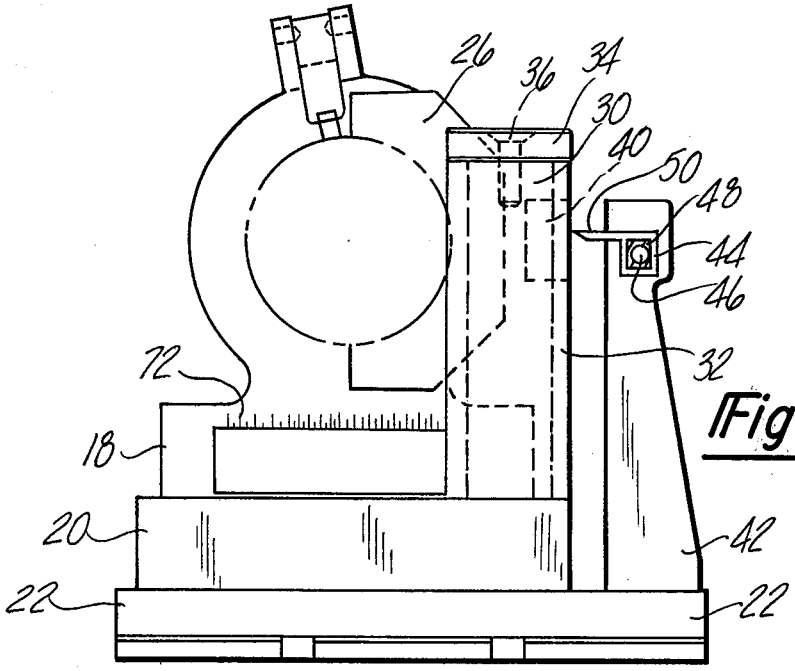
Fig-2

FORM RELIEVING APPARATUS

BACKGROUND OF THE INVENTION

I. Field of the Invention

The present invention relates to grinding apparatus and more particularly to such apparatus suitable for providing axial and radial relief on cutting tools such as drilling and reaming bits, milling cutters and taps.

II. Description of the Prior Art

Cutting tools such as drilling and reaming bits are commonly provided with lands having leading cutting edges. Radial relief behind the cutting edges prevents drag against the wall of the hole being drilled or reamed. The relief necessarily extends some distance axially or along a portion of the length of the cutting tool.

Some cutting tools are provided with stepped diameters which during fabrication require both axial and radial relief along lengths of the cutting tool at several different diameters.

Such relief of cutting tools has heretofore been accomplished by mounting the cutting tool in a rotatable spindle which in turn is carried by a movable support operable to move the tool radially and/or axially into a grinding wheel. Means are provided to reciprocally move the support the required axial and radial distance to accomplish relief cutting for the particular cutting tool carried by the spindle.

In some prior art form relieving devices a cam having a number of uniformly dropping cam surfaces equal in number to the number of cutting edges on the cutting tool is secured to the spindle and cooperate with a cam follower. Such cams, however, are subject to manufacturing errors which cause corresponding errors in the cutting tool being ground or sharpened. Moreover, a different cam is required for each different cutting tool.

SUMMARY OF THE PRESENT INVENTION

The present invention provides a simple, relatively inexpensive and yet totally effective form relieving apparatus.

In brief, the present invention comprises a base having a cross slide member mounted to it and slidable in a first direction. A carriage, in turn, is slidably mounted to the cross slide member and movable in a second direction perpendicular to the first direction. A workpiece holding spindle is mounted to the carriage.

Actuating means for moving the carriage and cross slide member includes radial pins carried by the spindle to form a cam follower which cooperates with a non-rotating cam. The cam in turn is secured to a lever having two outwardly extending arms and which is pivotally mounted at a midpoint to the cross slide member. The lever arms are perpendicular to each other.

The stationary cam provides a uniformly dropping surface while the radial pins are radially equidistantly spaced from the spindle center line. The pins are equal in number to the number of cutting edges on the cutting tool being sharpened or ground.

A first fulcrum is secured to the carriage and abuts against one lever arm while a second fulcrum is mounted to a post secured to the base and abuts against the other lever arm. Each fulcrum includes means for longitudinally adjusting its abutment position along its respective lever.

Rotation of the cam follower acting upon the cam pivots the lever about its pivot point which moves both the cross slide and the carriage via the lever arms. The magnitude of displacement for the cross slide and carriage can be independently adjusted by varying the longitudinal position of the fulcrum points.

The cam follower further preferably comprises a ring coaxially secured to the spindle and having a plurality of circumferentially spaced radial bores formed about its outer periphery. The radial bores are threaded and threadably receive the radial pins so that a portion of at least one pin extends radially outwardly from the ring to engage the cam. Each radial pin is independently and infinitely adjustable.

BRIEF DESCRIPTION OF THE DRAWINGS

A better understanding of the present invention will become apparent upon reading the following detailed description in conjunction with the accompanying drawing, wherein like reference characters refer to like parts throughout the several views, and in which:

FIG. 1 is a top plan view of the form relieving apparatus of the present invention;

FIG. 2 is an elevational end view as seen from the left side of FIG. 1;

DETAILED DESCRIPTION OF THE PRESENT INVENTION

Figure 3:
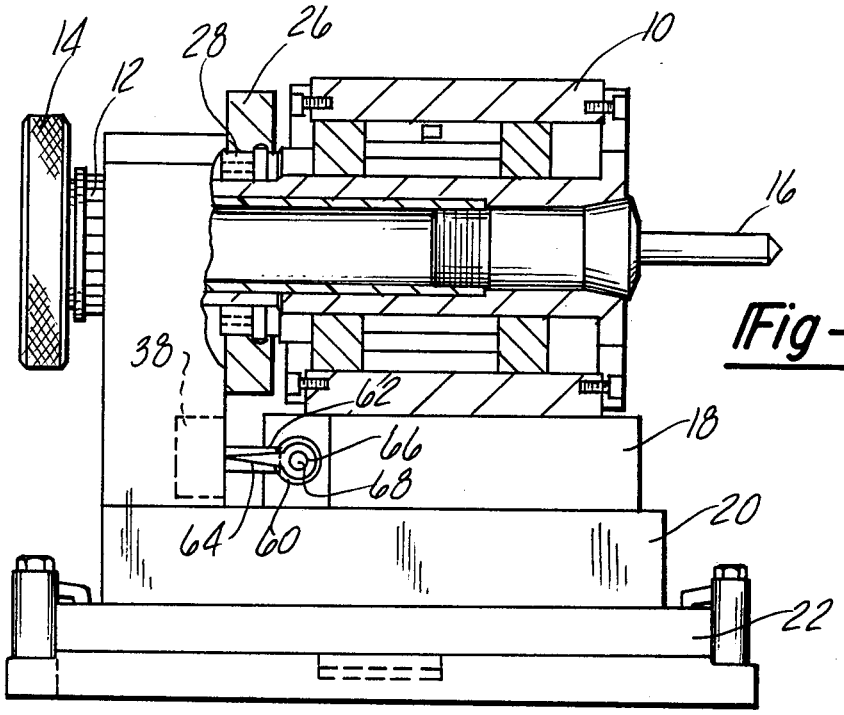
FIG. 3 is a partial fragmentary sectional view as seen from the side of FIG. 1.

Now referring to the drawings for a description of a preferred apparatus of the present invention, FIG. 1 illustrates the form relieving apparatus of the present invention as comprising a spindle 10 rotatably driven by conventional means such as motor (not shown) operatively connected to the spindle 10 through a drive pulley 12. A hand wheel 14 is provided for manually rotating the spindle 10. The spindle 10 carries a workpiece 16.

Figure 5:
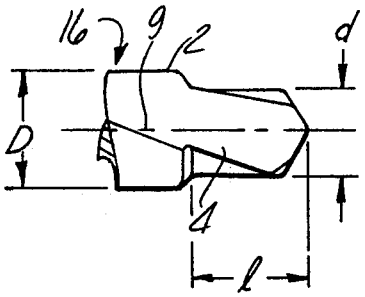
FIG. 5 is a fragmentary end elevational view of a drilling bit.
Figure 6:
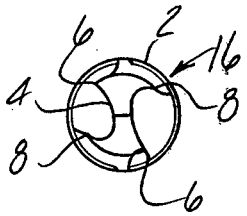
FIG. 6 is a view as seen from the right side of FIG. 5.

FIGS. 5 and 6 illustrate the workpiece 16 in the form of a drilling bit having helical lands 2 and flutes 4 having a major diameter D. A typical problem is to provide a reduced diameter portion on the end of the workpiece 16 having a diameter d to provide a stepped diameter drill. In order to carry out drilling and cutting operations, the leading edges 6 of the lands of the small diameter portion must be farther from the rotary axis 9 than the trailing edges 8 so that the trailing edges will not drag against the wall of the hole being drilled by the bit 16. Thus, the outer surface of the small diameter portion must be relieved over the axial length 1, and in a radial direction such that the radius from the axis 9 to the trailing edges 8 is less than the radial distance from the axis 9 to the leading edges 6. The usual procedure is to first spin grind or circular grind the small diameter portion to the diameter d and then relief grind the small diameter end portion.

Referring again to FIG. 1, the spindle 10 is fixed to a workpiece supporting carriage 18 which (as can best be seen in FIG. 3) in turn is slidably mounted to a cross slide member 20 which in turn is slidably mounted to a base 22. The carriage 18 is mounted to the cross slide member 20 to permit sliding movement in a direction parallel with the axis of the workpiece 16. Conversely, the cross slide member 20 is mounted to the base 22 to slide in a direction transverse to the axis of the workpiece 16. Thus, the carriage 18 moves relative to the base 22 and the cross slide member 20 upon a force being exerted against the carriage 18 in a direction parallel to the axis of the workpiece 16. Movement of the carriage 18 in a direction transverse to the axis of the workpiece 16 can be produced by exerting a force in the radial direction to either the carriage 18 or the slide member 20. The workpiece 16 will be moved axially and radially in response to movement of the carriage 18 and the cross slide 20 respectively.

Actuating means are provided to selectively produce movement of the cross slide member 20 and the carriage 18 to provide for movement of the workpiece 16 either axially toward and away from a grinding wheel 17 or radially with respect to the grinding wheel 17 or back and forth in a direction which is intermediate the radial and the axial movements of the workpiece 16.

Figure 4:
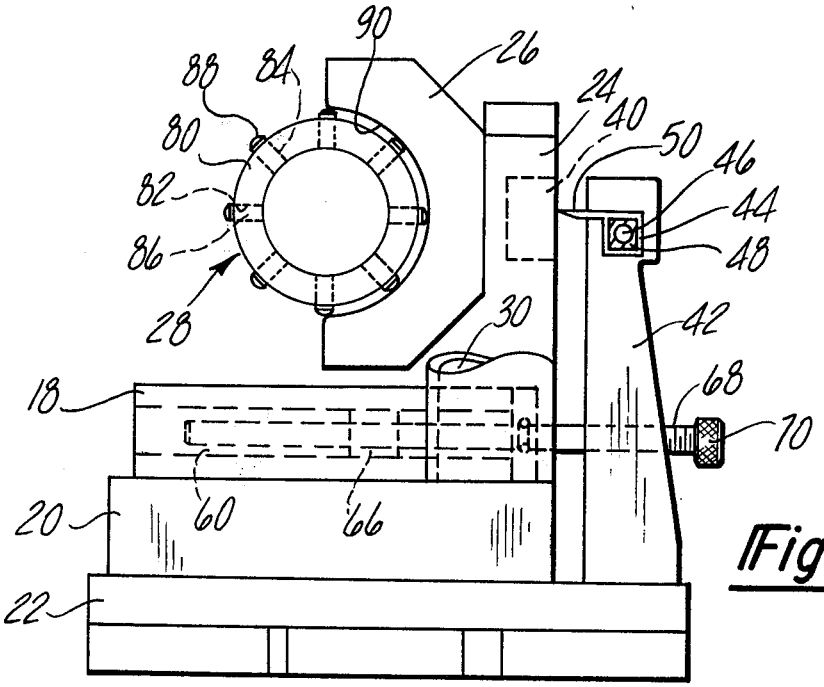
FIG. 4 is a view similar to FIG. 2, but with portions of the apparatus removed for purposes of clarity.

The actuating means, as can best be seen in FIG. 4, includes an upwardly extending cam post 24 which is integral with the cross slide member 20. The cam post 24 carries a cam 26 which is engaged with a cam follower 28 which will subsequently be described in greater detail. The cam follower 28 rotates with the spindle 10 and imparts reciprocating movement, transverse to the axis of rotation, to the cam post 24. As can best be seen in FIG. 1, the cam post 24 is pivotal around a pivot post 30 which extends upwardly from and which is preferably integral with the cross slide member 20.

As can best be seen in FIG. 2, a cylindrical member 32 fits over the post 30 and is mounted thereto by a cap 34 and a screw 36 such that the member 32 is pivotal with respect to the post 30.

As can best be seen in FIG. 1, arms 38 and 40 extend at right angles from the member 32 so that the arms 38 and 40 pivot as a single unit about the post 30.

Referring again to FIG. 2, a post 42 extends upwardly from the base and is provided with a longitudinal chamber 44 extending adjacent to and opening to the arm 40. An adjusting screw 46 extends into the chamber 44 and carries a nut 48. The adjusting screw 46 is rotatably mounted to the post 42 such that rotation of the screw 46 produces longitudinal movement of the nut 48 in the chamber 44. The nut 48 carries a fulcrum member 50 which engages the arm 40 at a longitudinal point which depends upon the longitudinal position of the nut 48. Indicia 52 is provided on the base 22 to indicate the longitudinal position of the fulcrum member 50.

Thus a force exerted on the arm 40 in a downward direction as viewed in FIG. 1 will cause the arm 40 to pivot on the fulcrum provided by member 50 and thus exert a clockwise force against the post 30 to thereby move the cross slide member 20 towards the top of FIG. 1 and to the left as seen in FIG. 2. This moves the workpiece 16 radially toward the grinding wheel 17.

Referring now to FIGS. 1, 2 and 3, the rearward portion of the carriage is provided with a cavity 60 which extends parallel to the rear edge of the carriage 18. The cavity 60 has a rearwardly opening portion 62 to permit a fulcrum member 64 to extend therethrough to engage the forward edge of the arm 38. The fulcrum member 62 is carried by a nut 66 disposed within the cavity 60. An adjustable screw member 68 having a knurled knob 70 at one end is carried in the carriage 18 so that rotation of the knob 70 moves the nut 66 in the cavity 60 to thereby move the fulcrum member 64 along the arm 38.

As can best be seen in FIG. 2, indicia 72 is provided on the carriage 18 to indicate the position of the fulcrum member 64 with respect to the arm 38.

It should be apparent that the clockwise rotation of the arms 38, 40 as produced by the cam 28 and the fulcrum member 64 produces a movement of the carriage 18 to the right as viewed in FIGS. 1 and 3. This causes the workpiece 16 to be moved axially toward the grinding wheel 16.

Thus, depending upon the position of the fulcrum members 50 and 62 with respect to the arms 40 and 38, respectively, the workpiece 16 will be moved only axially toward the grinding wheel 17, radially toward the grinding wheel 17 or it will be moved in a direction between these directions.

If, for instance, the screw 46 is rotated to position the nut member 48 and thus the fulcrum member 50 to the extreme left as viewed in FIG. 1, all of the force exerted by the cam 26 against the portion 24 will be converted to a force against the fulcrum 64 to move the carriage 18 axially with respect to the grinding wheel 17. There will, in this position of the fulcrum member 50, be no radial movement of the workpiece 16. Positioning the fulcrum member 50 anywhere between the extreme left and the extreme right position, as viewed in FIG. 1, produces a situation in which force is exerted against the post 30 to move the carriage 18 radially ranging from zero to a maximum.

Likewise, positioning the fulcrum member 64 to the extreme left as viewed in FIG. 4 causes a maximum axially directed force to be applied to the fulcrum member 64 and thus the carriage 18 upon rotation of the arm 38 about the post 30. Positioning the fulcrum member toward the right as viewed in FIG. 4 reduces the axial force applied to the carriage 18 upon rotation of the arm 38 about the post 30 so that in the extreme right position, no axial force at all is exerted against the carriage 18 and the workpiece 16 will only be moved radially in response to rotation of the cam follower 28.

With reference now particularly to FIGS. 3 and 4, the cam follower 28 further comprises an annular ring 80 having a plurality of circumferentially spaced radial bores 82 formed about its outer periphery. Each bore 82 includes internal threads 84 and, as shown in the drawing, the ring includes eight equidistantly spaced bores 82 although more or less bores can be provided as required.

An externally threaded cylindrical radial pin 86 threadably engages each bore 82 so that one end 88 of each pin 86 extends radially outwardly from the ring 80. The radially outward protrusion of each pin 86 from the ring 80 can be independently and infinitely adjusted by adjusting the rotational position of each pin 86 in its respective bore 82.

Upon rotation of the cam follower 28, the outwardly protruding portions 88 of the pins 86 strike a semicircular cam or uniformly dropping surface 90 on the cam 26 and, in doing so, imparts the previously described motion to the cam 26 and, thus, to the cam post 24. For multiple edge cutting tools the outer or free end of each pin 86 is radially equidistancely spaced from the center line of the spindle 10. The pins 86 can be accurately preset by rotational adjustment of the pins 86. The number of pins 86, of course, is equal to the number of cutting edges on the cutting tool since a separate axial and/or radial relief motion is produced as each pin 86 engages the uniforming dropping cam surface 90 on the stationary cam 26.

Alternatively, when the cutting tool has only one cutting edge, the pins 86 can be preset at sequentially lower heights, i.e. the radial distance from the spindle center line, to thereby produce a single relief motion per full revolution of the spindle.

Figure 7:
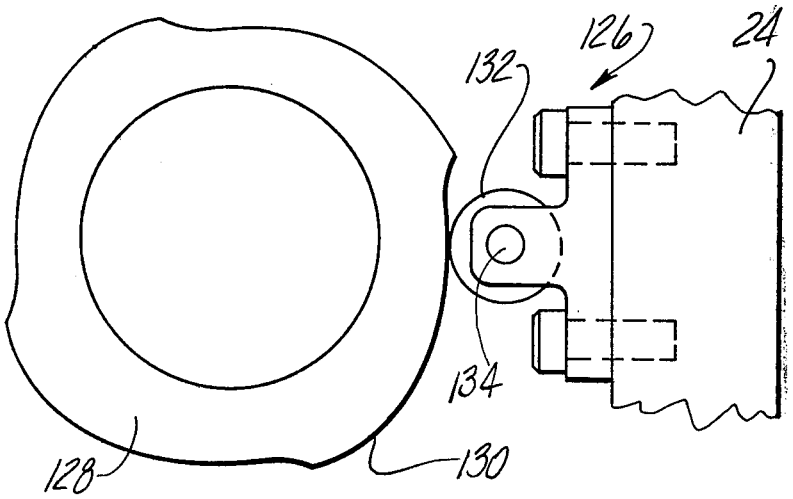
FIG. 7 is a fragmentary elevational view of another preferred cam and cam follower for the apparatus of the present invention.

With reference now to FIG. 7, another preferred cam 128 and cam follower 126 are thereshown in which the outer surface 130 of the cam 128 is contoured in the fashion necessary to impart the desired reciprocal action to the carriage 18. The cam follower 126 includes a roller 132 rotatably mounted by a bearing 134 to the cam post 24. The roller 132 engages and follows the cam surface 130. The cam surface 130 for the cam 128, unlike the cam follower 28, is fixed and, therefore, must be replaced with a new cam when a different reciprocating action for the carriage is required.

It will be understood, however, that the adjustable cam means, best shown in FIG. 4, can be employed in applications other than the relief grinding apparatus 10 of the present invention.

It can, therefore, be seen that the apparatus 10 of the present invention provides a simple, relatively inexpensive and yet totally effective means for relief grinding.

Having described our invention, however, many modifications thereto will become apparent to those skilled in the art to which it pertains without deviation from the spirit of the invention as defined by the scope of the appended claims.

We claim:

1. A form relieving apparatus comprising:

a base;

a cross slide member slidably mounted to said base in a first direction;

a carriage slidably mounted to said cross slide member to move in a second direction, said second direction being perpendicular to said first direction;

rotatable spindle means carried by said carriage, said spindle means being adapted to hold an elongated workpiece;

said second direction being in a direction parallel to the longitudinal axis of said workpiece;

means for moving said carriage relative to said base, said moving means comprising;

a lever having a first and second arm, said arms being substantially perpendicular to each other, said lever being pivotally mounted to said cross slide member;

cam follower means secured to said spindle means, said cam follower means cooperating with cam means secured to said lever to produce pivotal movement of said lever;

first means for connecting said base to said first lever arm to move said cross slide in said first direction in response to pivotal movement of said lever;

second means for connecting said carriage to said second lever arm to move said carriage in said second direction in response to pivotal movement of said lever;

said first means further comprising a fulcrum positioned in between a support secured to said base and said first lever arm and means for selectively positioning said fulcrum longitudinally along said first lever arm; and said second means further comprises a further fulcrum positioned in between said carriage and said second lever arm and means for selectively positioning said further fulcrum longitudinally along said second lever arm;

wherein a pivotal movement of said lever causes said lever arms to transmit forces to said carriage and said cross slide member to move said carriage in said first and second directions the magnitude of movement of said carriage in each of said first and second directions being dependant upon the positions of said fulcrum.

2. The invention as defined in claim 1 wherein said cam follower means further comprises a ring coaxially secured to said spindle, said ring having a plurality of circumferentially spaced threaded bores formed about its outer periphery, and a plurality of threaded members, each threaded member being partly threadably received in one threaded bore so that a portion of at least one member protrudes radially outwardly from the ring.

3. The invention as defined in claim 1 wherein said cam follower means further comprises a ring secured to said spindle, a plurality of circumferentially spaced members secured to said ring, at least one member having a part which protrudes radially outwardly from said ring, and means for independently variably adjusting the outward protrusion of each member from said ring.

4. The invention as defined in claim 3 wherein said last mentioned means includes means for infinitely variably adjusting the outward protrusion of each member.

* * * * *

UNITED STATES PATENT AND TRADEMARK OFFICE

CERTIFICATE OF CORRECTION

PATENT NO. : 4,261,142

DATED : April 14, 1981

INVENTOR(S) : Raymond F. Nixon and Gait Barr

It is certified that error appears in the above-identified patent and that said Letters Patent are hereby corrected as shown below:

Column 4, line 1, delete "62" and insert --64-- therefor;

Column 4, line 15, delete "16" and insert --17-- therefor;

Column 4, line 17, delete "62" and insert --64-- therefor;

Column 5, line 5, delete "uniforming" and insert --uniformly-- therefor.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*